US005733233A

United States Patent [19]

Webber

[11] Patent Number: 5,733,233

[45] Date of Patent: Mar. 31, 1998

[54] EXERCISE APPARATUS WITH ADJUSTABLE ROLLER PADS

[76] Inventor: Randall T. Webber, 11162 Morning Creek Dr., San Diego, Calif. 92128

[21] Appl. No.: 579,972

[22] Filed: Dec. 28, 1995

[51] Int. Cl.[6] ..... A63B 21/062; A63B 23/04

[52] U.S. Cl. ..... 482/137; 482/100; 482/134; 482/138; 482/139; 482/142

[58] Field of Search ..... 482/98–100, 133–135, 482/137–139, 908, 134, 142, 145

[56] References Cited

U.S. PATENT DOCUMENTS

| | | | |
|---|---|---|---|
| 4,448,412 | 5/1984 | Brentham | 482/137 |
| 4,635,933 | 1/1987 | Schnell | 482/137 |
| 4,678,185 | 7/1987 | Mahnke | 482/100 |
| 4,711,448 | 12/1987 | Minkow et al. | 482/137 |
| 4,732,380 | 3/1988 | Maag | 482/134 |
| 4,809,972 | 3/1989 | Rasmussen et al. . | |
| 4,828,255 | 5/1989 | Lahman | 482/142 |
| 4,900,018 | 2/1990 | Ish, III et al. . | |
| 5,085,430 | 2/1992 | Habing . | |
| 5,236,406 | 8/1993 | Webber | 482/100 |
| 5,338,274 | 8/1994 | Jones | 482/137 |
| 5,518,477 | 5/1996 | Simonson | 482/138 |
| 5,562,579 | 10/1996 | Scheokowitz | 482/137 |

OTHER PUBLICATIONS

Cybex Leg Extension/Curl Product Brochure.
Nautilus Personal Circuit™0 Gym Product Brochure.
Paramount® Fitness Center Product Brochure.

*Primary Examiner*—Richard J. Apley
*Assistant Examiner*—Victor K. Hwang
*Attorney, Agent, or Firm*—Brown, Martin, Haller & McClain, LLP

[57] ABSTRACT

In a weight lifting exercise apparatus, an adjustable leg exercise station is provided which allows both leg extensions and leg curls to be performed in a sitting position. A leg exercise arm carrying leg engaging roller pads is pivotally mounted on a seat supporting member on the support frame of the apparatus, and is linked to an exercise resistance such as a weight stack. A second roller pad assembly is pivotally mounted on the seat supporting member adjacent the leg exercise arm, and is movable between a down position engaging behind a user's knees for performing leg extension exercises, and a raised position resting on top of the user's thighs when performing leg curls or pull down exercises.

6 Claims, 5 Drawing Sheets

EXERCISE APPARATUS WITH ADJUSTABLE ROLLER PADS

BACKGROUND OF THE INVENTION

The present invention relates to exercise apparatus of the weight lifting type which includes exercise stations for exercising various different muscle groups. Each station is linked to a weight stack or other resistance device, normally by means of a pulley and cable linkage system. The invention is particularly concerned with a leg exercising station of a weight lifting machine for performing leg exercises in a seated position.

Normally, weight lifting exercise machines include apparatus for performing leg extension exercises, such as leg hamstring curls and leg extensions. Leg extensions are normally performed in a sitting position by lifting an arm carrying a roller at the end, the user pushing up against the roller with their lower leg. Leg curls are normally performed in a standing position, either using the same roller arm and lifting it with the back of the legs, or using a different exercise device such as ankle straps linked to the weight stack. When leg curls are performed in a standing position, only one leg can be exercised at a time, extending the length of the exercise period. Additionally, it is inconvenient to have to move into different positions to perform different types of exercises. One example of this type of apparatus is described in U.S. Pat. No. 4,900,018 of Ish, III et al.

Leg exercise stations have been proposed in the past which permit leg extensions and leg curls to be performed in a sitting position, but require use of a seat belt to hold the body down when performing leg curls.

SUMMARY OF THE INVENTION

It is an object of the present invention to provide a new and improved leg exercise station for a weight lifting machine.

According to the present invention, an exercise apparatus is provided which comprises a support frame, a seat assembly mounted on the frame, a resistance device on the frame for providing resistance to exercises performed on the apparatus, a leg exercise arm pivotally mounted on the frame at a location spaced forwardly from the seat assembly, the leg exercise arm having leg engaging members such as roller pads for engagement by a user's legs when seated on the seating assembly to perform leg extension and leg curl exercises, the leg exercise arm being linked to the resistance device for providing resistance to leg exercises, and a roller pad assembly adjustably mounted on the frame adjacent the leg exercise arm and movable between a down position in which the roller pad assembly engages behind a user's knees for providing a support surface while the user is performing leg extension exercises and a raised position in which the roller pad assembly engages on top of a user's thighs for providing a bearing surface and resisting raising of the user's legs while performing leg curl exercises.

Preferably, the roller pad assembly is pivotally mounted on a seat supporting portion of the frame at a location spaced forwardly of the seat, and a stop surface on the frame prevents downward movement of the pad assembly beyond the down position behind a seated user's knees. The roller pad assembly pivots freely upwards from the down position into a raised position resting on the user's thighs, so that it adjusts automatically for different leg sizes. In a preferred embodiment of the invention, the roller pad assembly comprises a U-shaped bracket for engaging over a seat supporting arm of the frame in the down position of the pad assembly, and first and second roller pads extending transversely from opposite arms of the U-shaped bracket. The bracket is pivotally mounted on the seat supporting arm. When the user wishes to perform leg curl exercises, they simply lift the bracket and roller pads upwardly, position their legs beneath the respective first and second roller pads, and then lower the assembly until the pads rest on the opposite thighs of the user. The user can then perform leg curl exercises with the lower ends of his or her legs positioned in front of the roller, and push back against the roller arm to move it rearwardly against the resistance of the weight stack or other resistance device.

With this arrangement, it will be easy and convenient to perform both leg curl and leg extension exercises while seated in the same position, simply by adjusting the position of a roller pad assembly between a location resting on the user's thighs and a position behind the user's knees. Both legs can be exercised simultaneously when performing leg curls, unlike previous arrangements in which it was necessary to perform leg curls in a standing position.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
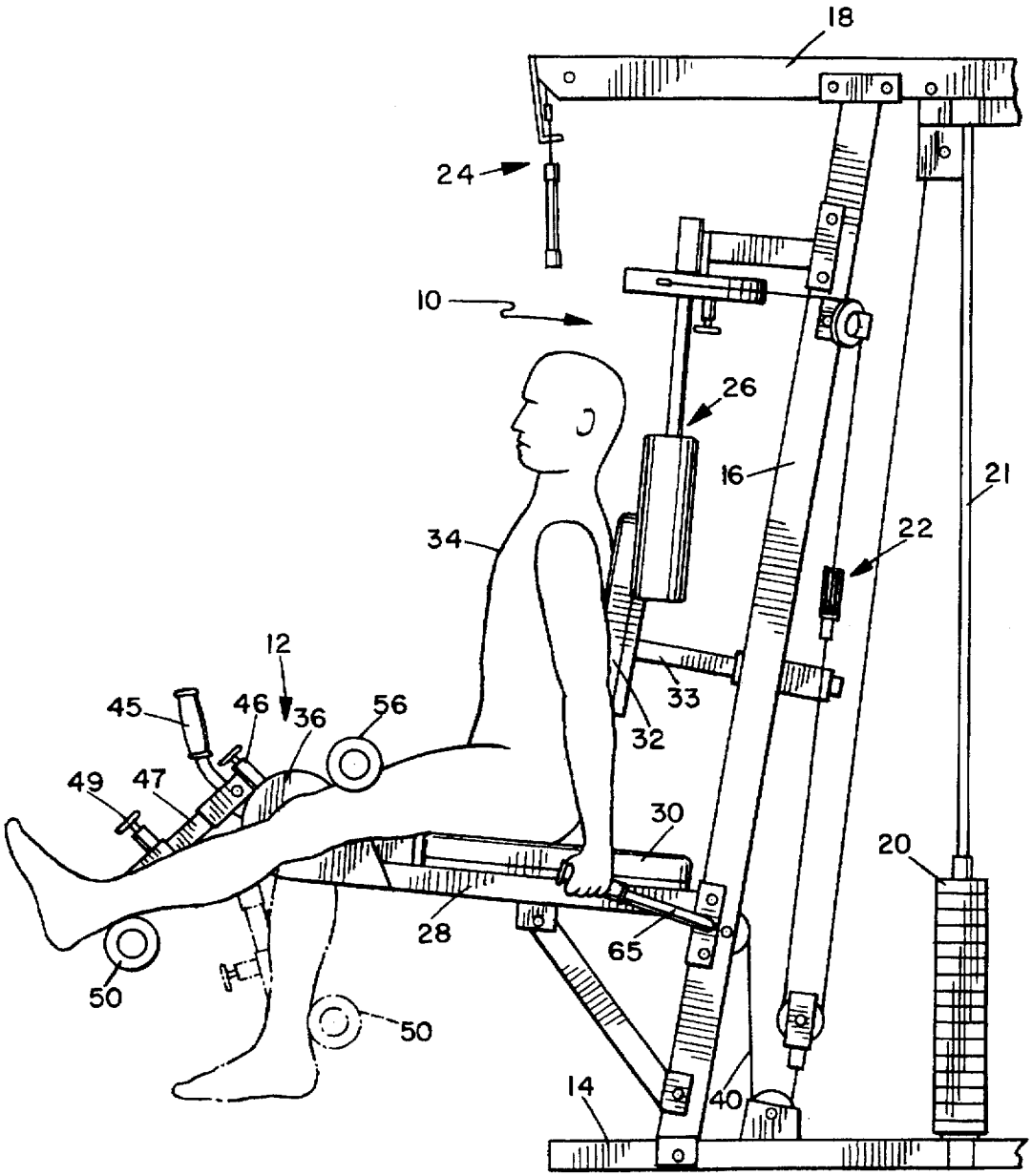
FIG. 1 is a side elevational view of an exercise apparatus with an adjustable roller pad assembly according to a preferred embodiment of the invention, illustrating the roller pads in a first position for performing leg curls.

The drawings illustrate an exercise apparatus 10 of the weight lifting type incorporating a leg exercise station 12 according to a preferred embodiment of the present invention. The apparatus 10 includes a support frame having a base 14, a forward upright 16, and an upper crossbar 18. A conventional weight stack 20 is slidably mounted on guide rods 21 which extend from the base 14 to the crossbar 18. The weight stack is linked via a cable and pulley mechanism 22 to various exercise stations, including the leg exercise station 12, pull down station 24, chest press station 26, and other exercise stations which are not illustrated in the drawings.

Figure 2:
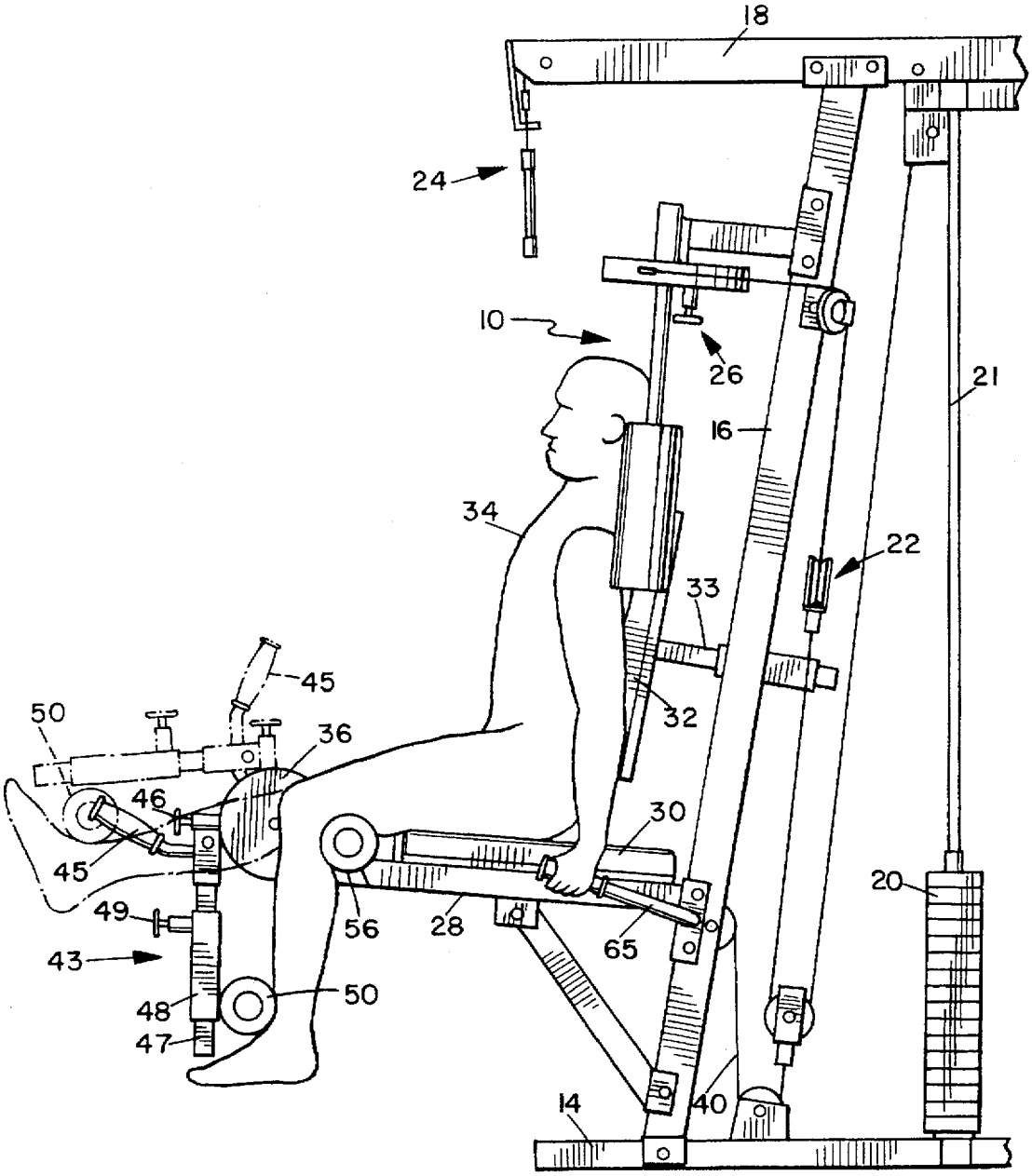
FIG. 2 is a side elevational view similar to FIG. 1 illustrating the roller pads in a second position for performing leg extensions.

A seat supporting arm 28 is secured to the upright 16 so as to project forwardly from the upright, and supports a seat pad 30 in a conventional manner. A backrest 32 is adjustably mounted on the upright 16 via adjustable mounting arm 33 at an appropriate location for providing a back support to an individual 34 seated on pad 30, as best illustrated in FIGS. 1 and 2. Arm 28 projects forwardly from seat pad 30 and supports the leg exercise station 12.

Figure 3:
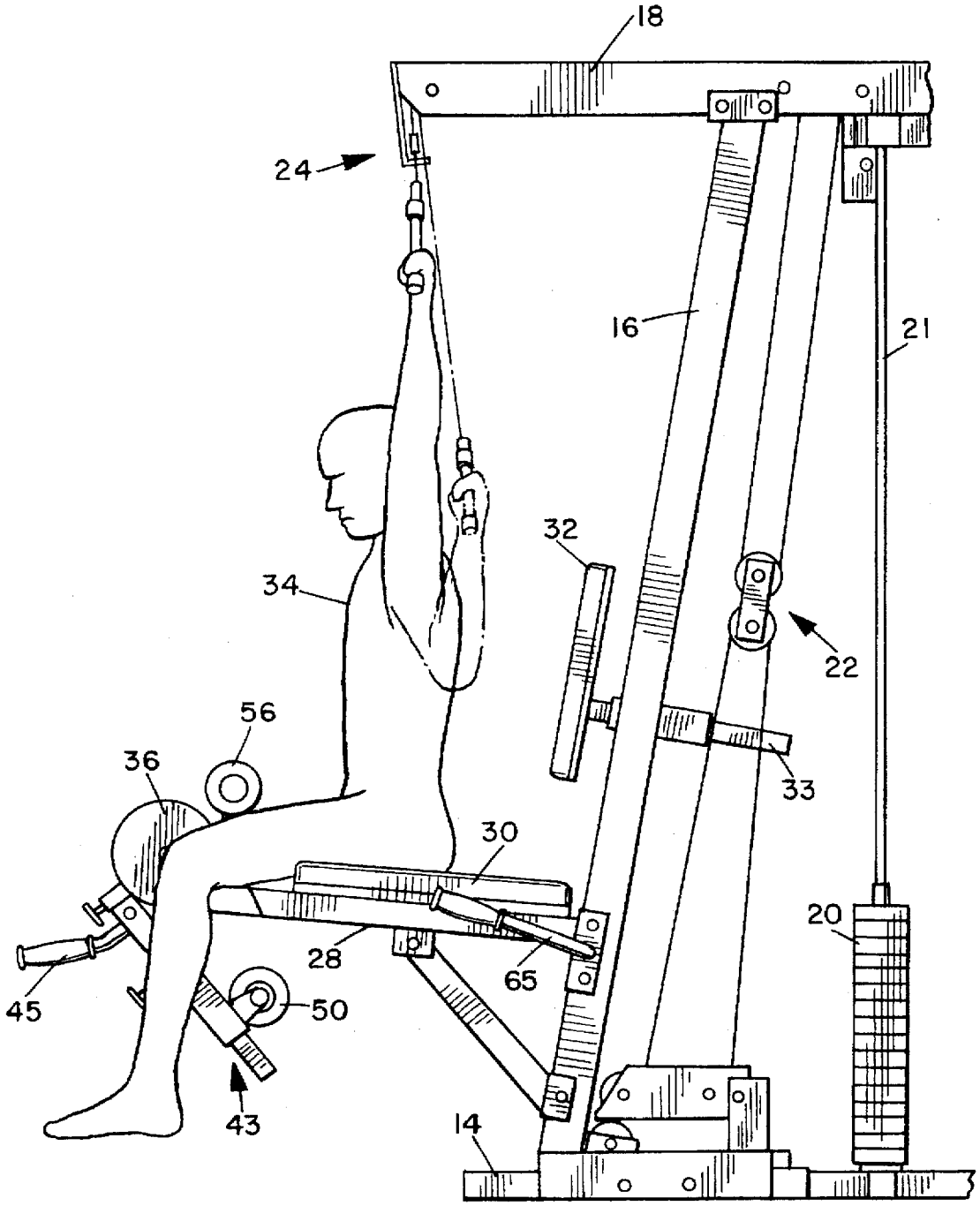
FIG. 3 is another side elevational view illustrating the apparatus in a different position for performing pull down exercises.
Figure 4:
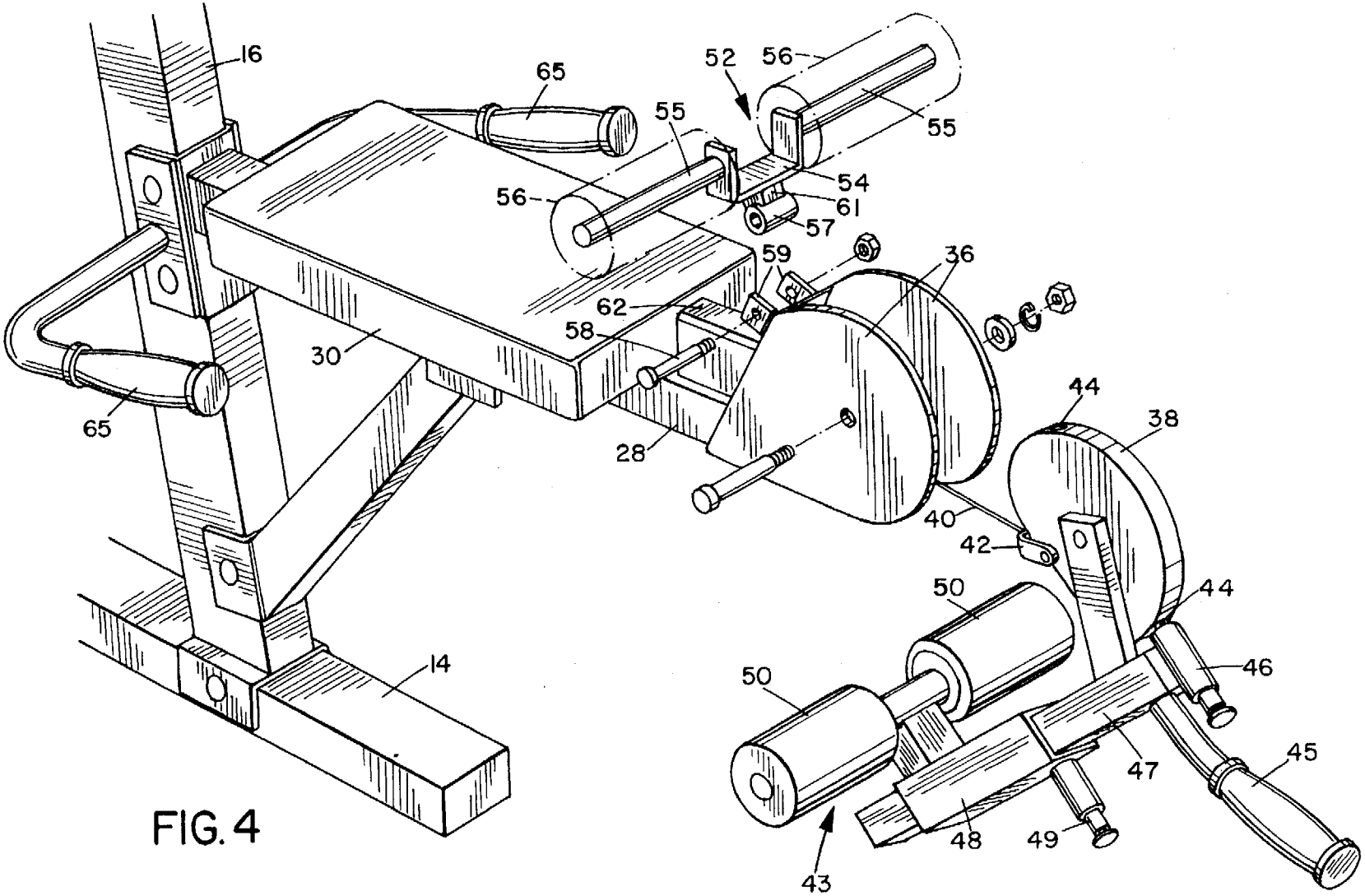
FIG. 4 is an exploded perspective view of the leg exercise station and adjustable roller pad assembly of FIGS. 1–3.
Figure 6:
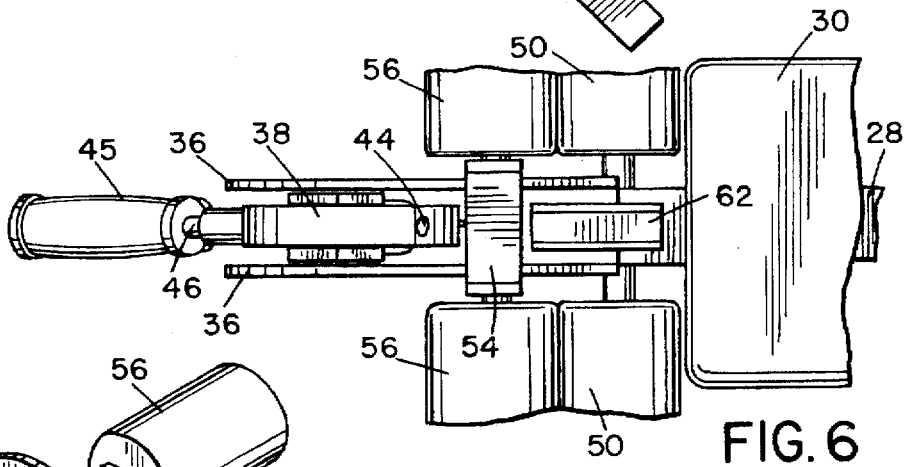
FIG. 6 is a top plan view of the leg exercise arm and adjustable roller pads.

Leg exercise station 12 includes a pair of spaced, parallel mounting plates 36 projecting from the forward end of arm 28, and a bi-directional pulley 38 rotatably mounted between plates 36, as illustrated in FIGS. 4 and 6. Pulley 38 is attached to cable 40 of the cable and pulley linkage via a swivel member 42 so that the cable may be wrapped in either direction around pulley 38. A leg exercise arm 43 of adjustable length is secured to pulley 38 via spring-loaded locking pin 46 which is secured to arm 43 and extends through an aligned opening 44 in the perimeter of pulley 38, as illustrated in FIG. 4. A series of spaced openings 44 are provided to allow the leg exercise arm to be secured to the pulley in any one of several possible positions. A handle 45 allows the user to move the arm readily between the inoperative position of FIG. 3, the leg extension position of FIG. 2, and the leg curl position of FIG. 1. The spring-loaded locking pin 46 is retracted to allow the angular orientation of arm 43 to be adjusted, and is released to lock the arm on the pulley 38 in any one of the selected positions.

Arm 43 includes an inner tubular portion 47 and an outer sleeve 48 which is releasably securable to inner portion 47 at a selected position via locking or pop pin 49. A pair of roller pads 50 are mounted adjacent the end of sleeve 48 for engagement by a user's legs when performing either leg extension or leg curl exercises. Thus the position of the roller pads can be adjusted to accommodate user's with different length legs.

Figure 5:
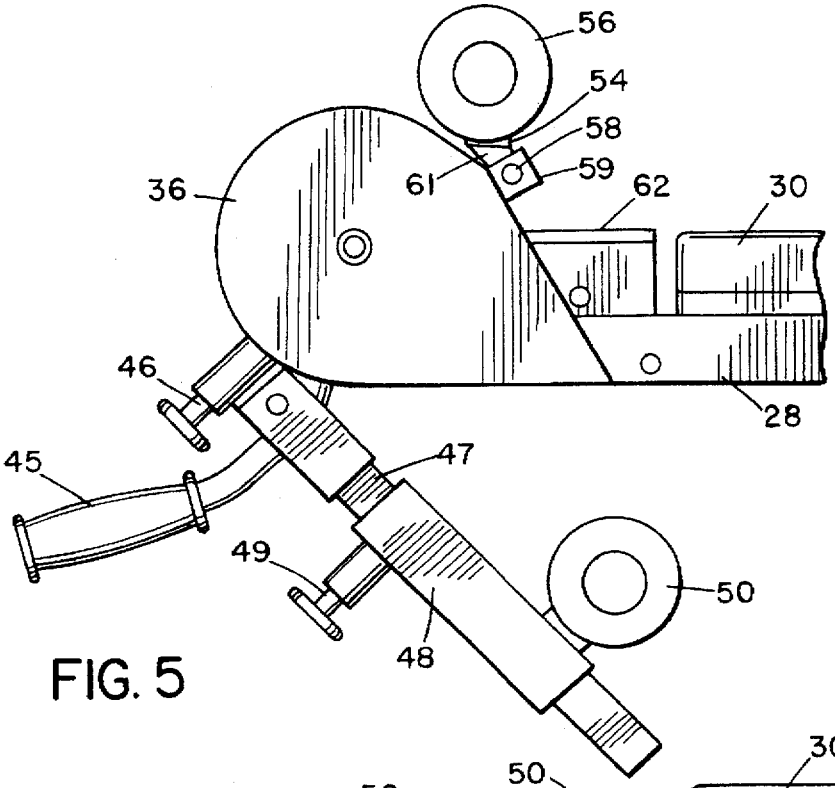
FIG. 5 is an enlarged side elevational view of the leg exercise arm and adjustable roller pad assembly.
Figure 7:
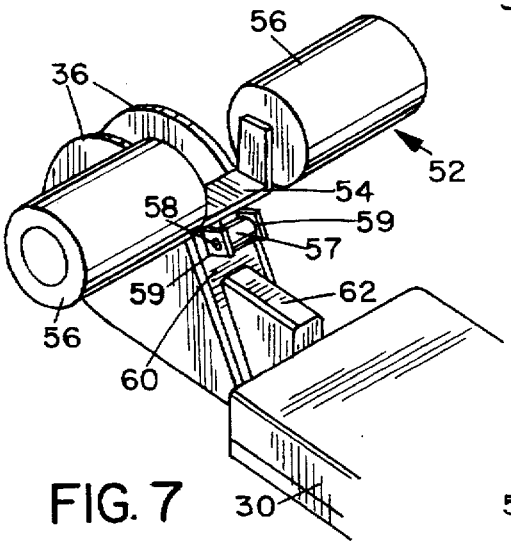
FIG. 7 is a rear perspective view of the leg exercise station illustrating the adjustable roller pad assembly in a raised position.
Figure 8:
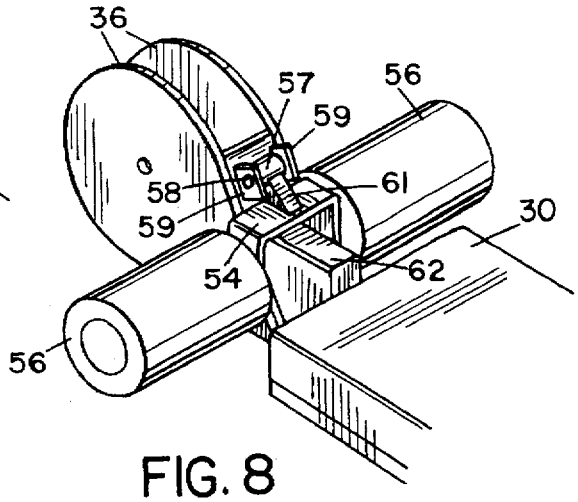
FIG. 8 is a view similar to FIG. 7 illustrating the adjustable roller pad assembly in a lowered position.

An adjustable second roller pad assembly or swing arm 52 is pivotally mounted on plates 36 adjacent the end of the seat supporting arm 28, as best illustrated in FIGS. 4–8. As best illustrated in FIG. 4, the assembly 52 basically comprises a central, U-shaped bracket 54 with roller support rods 55 projecting in opposite directions from the opposite arms of the bracket, and a pair of roller pads 56 mounted on the respective rods 55. A pivot sleeve 57 is secured to the center of bracket 54 for rotatable engagement over pivot pin 58 extending between end plates 59. Plates 59 are secured to plate 60 which extends between the rear edges of parallel plates 36, as best illustrated in FIGS. 4 and 8. The pivot sleeve 57 is secured to the bracket 54 via angled arm 61 so that the sleeve is offset to one side of the bracket, as best illustrated in FIG. 5. A generally rectangular seating bracket 62 is secured to the forward end of support arm 28 between the front edge of seat pad 30 and the pulley support plates 36, so as to project upwardly to about the level of seat pad 30, as best illustrated in FIGS. 5, 7 and 8. The bracket 62 forms a stop defining the lowermost position of the roller pad assembly 52. When the roller pads 56 are rotated in a clockwise direction, the U-shaped bracket 54 will be seated over bracket 62 as illustrated in FIGS. 2 and 8, holding the roller pads 56 in their lowermost position. In this position, the pads will be located behind the knees of a user in a seated position on seat pad 30, as illustrated in FIG. 2, to provide support for performing leg extension exercises.

When the roller pad assembly is rotated in an anti-clockwise direction upwardly from the position illustrated in FIG. 8 to the position illustrated in FIG. 7, it may be placed on top of the seated user's thighs, if desired, as illustrated in FIGS. 1 and 3. In this position, the roller pads act to hold down the user's legs when performing leg curls as in FIG. 1 or pull down exercises as in FIG. 3. If the user is performing upper body exercises in a seated position, the leg exercise arm 43 will be pulled back and locked in the retracted position, as illustrated in FIG. 3. Where the user is performing pull down exercises by pulling down on the handle bar 66 at pull down station 24, the adjustable roller arm should first be raised. The user then sits in a comfortable, forward position on seat pad 30 below the pull down station, and the roller pads 56 are lowered until they rest on the user's thighs, as illustrated in FIG. 3. In this position, the roller pads act to hold down the user's legs while the exercises are performed.

If the user wishes to perform leg curl exercises, the exercise arm 43 is moved to the raised position as illustrated in solid lines in FIG. 1, with the roller pads 56 still resting on the user's thighs to hold down the legs. The user rests both ankles on top of the respective exercise arm roller pads 50 as illustrated, and pushes back into the dotted line position, repeating the exercise as often as desired. Handles 65 are mounted on upright 16 at an appropriate height for gripping by the user for support when performing leg exercises, as illustrated in FIG. 1.

In order to perform leg extension exercises, the adjustable roller pad assembly is lowered into the lowermost position, and the leg exercise arm 43 is adjusted into the intermediate position illustrated in solid lines in FIG. 2. The user then sits on the seat with the roller pads 56 positioned behind the user's knees and the roller pads 50 on arm 43 positioned in front of the user's ankles. The user then grips handles 65 and pushes arm 43 forwards with both legs into the dotted line position of FIG. 2. This movement is repeated as often as desired.

The adjustable roller arm assembly thus permits leg extension and leg curl exercises to be performed readily in a sitting position, exercising both legs simultaneously in each case. Seat belts and the like are not needed to hold the user down while carrying out leg curls or pull down exercises, unlike some previous arrangements. Instead, the roller pads 56 resting on the user's thighs stop the legs from popping up and also give the bicep room to flex completely, which would non be possible if the roller pads 56 were located behind the user's knees. It is also advantageous to perform leg curls in a sitting position, rather than in a standing position as in some previous machines, since better back support is provided, reducing the risk of strain. When positioned in the down position behind the user's knees, the roller pads 56 hold the knees in the correct position and provide support under the leg while performing kick up or leg extension exercises.

The adjustable roller arm assembly may be mounted on any multi-exercise weight machine in an equivalent position adjacent the seat pad to permit both leg extensions and leg curls to be performed in a sitting position.

Although a preferred embodiment of the invention has been described above by way of example only, it will be understood by those skilled in the field that modifications may be made to the disclosed embodiment without departing from the scope of the invention, which is defined by the appended claims.

I claim:

1. An exercise apparatus, comprising:

a support frame having a forward end and a rear end;

a seat assembly mounted on the frame for performing exercises in a seated position;

a resistance device mounted on the frame for providing resistance to exercises performed on the apparatus;

a leg exercise arm pivotally mounted on the frame at a location spaced forwardly from the seat assembly, the leg exercise arm being linked to the resistance device for providing resistance both to movement of said leg exercise arm in a first, outward direction to perform leg extension exercises, and to movement of said leg exercise arm in a second, inward direction to perform leg curl exercises, and having leg engaging members for engagement by a user's legs when seated on the seat assembly to perform leg extension and curl exercises;

a roller pad assembly adjustably mounted on the frame adjacent the leg exercise arm, and having at least one roller pad for engaging a user's legs, the assembly being movable between a lowered position in which the roller pad is located behind a seated user's knees and a raised position in which the roller pad engages the top of a seated user's thighs;

the roller pad assembly comprising means for providing a support surface for performing leg extension exercises and for holding down the legs when performing leg curl exercises; and a bi-directional pulley linking said resistance means to said leg exercise arm to provide resistance to movement of said arm in opposite directions.

2. The apparatus as claimed in claim 1, wherein the roller pad assembly is pivotally mounted on the frame for movement between said lowered and raised position and rests freely on top of a user's legs in said raised position.

3. The apparatus as claimed in claim 1, wherein the frame includes an upright member and a seat supporting member projecting forwardly from the upright member and having a forward end, the seat assembly including a seat pad mounted on the seat supporting member at a location spaced rearwardly from the forward end of the seat supporting member, and the leg exercise arm being pivotally mounted at the forward end of the seat supporting member, the roller pad assembly being mounted between the seat pad and leg exercise arm.

4. An exercise apparatus, comprising:

a support frame having a forward end and a rear end;

a seat assembly mounted on the frame for performing exercises in a seated position;

a resistance device mounted on the frame for providing resistance to exercises performed on the apparatus;

a leg exercise arm pivotally mounted on the frame at a location spaced forwardly from the seat assembly, the leg exercise arm being linked to the resistance device for providing resistance to leg exercises, and having leg engaging members for engagement by a user's legs when seated on the seat assembly to perform leg exercises;

a roller pad assembly adjustably mounted on the frame adjacent the leg exercise arm, and having a pair of roller pads for engaging a user's legs, the assembly being movable between a lowered position in which the roller pads are located behind a seated user's knees and a raised position in which the roller pads engage the top of a seated user's thighs;

the roller pads comprising means for providing a support surface for performing leg extension exercises and for holding down the legs when performing leg curl exercises;

the frame including an upright member and a seat supporting member projecting forwardly from the upright member and having a forward end, the seat assembly including a seat pad mounted on the seat supporting member at a location spaced rearwardly from the forward end of the seat supporting member, and the leg exercise arm being pivotally mounted at the forward end of the seat supporting member, the roller pad assembly being mounted between the seat pad and leg exercise arm; and the roller pad assembly including a U-shaped central bracket, one of said roller pads projecting outwardly in a first direction from said central bracket and the other roller pad projecting outwardly from said bracket in an opposite direction to said first direction, and pivotal mounting means for pivotally mounting said bracket on said seat supporting member, whereby said U-shaped bracket is seated over said seat supporting member adjacent said seat pad in said lowered position.

5. The apparatus as claimed in claim 4, wherein said pivotal mounting means comprises a first pivot member secured to said U-shaped bracket and a second pivot member secured to said seat supporting member and rotatably secured to said first pivot member.

6. The apparatus as claimed in claim 5, wherein said U-shaped member has a flat, central wall and a pair of side walls each projecting at a right angle to opposite ends of said central wall, and said first pivot member comprises a pivot sleeve and an arm securing said pivot sleeve to said flat central wall of said U-shaped member, said arm projecting at an angle to said central wall, and said sleeve being oriented parallel to the central axis of said central wall and offset to one side of said axis.

* * * * *